US006527575B2

(12) United States Patent
Scholler

(10) Patent No.: US 6,527,575 B2
(45) Date of Patent: Mar. 4, 2003

(54) ELECTRICAL PLUG CONNECTOR HALF

(75) Inventor: Johann Scholler, Deggendorf (DE)

(73) Assignee: Hypertac GmbH, Deggendorf (DE)

( * ) Notice: Subject to any disclaimer, the term of this patent is extended or adjusted under 35 U.S.C. 154(b) by 0 days.

(21) Appl. No.: 09/898,373

(22) Filed: Jul. 3, 2001

(65) Prior Publication Data

US 2002/0048984 A1 Apr. 25, 2002

(30) Foreign Application Priority Data

Jul. 4, 2000 (DE) ..... 100 32 417

(51) Int. Cl.[7] ..... H01R 13/62
(52) U.S. Cl. ..... 439/321; 439/320
(58) Field of Search ..... 439/321, 320, 439/322, 323, 312

(56) References Cited

U.S. PATENT DOCUMENTS 3,517,371 A * 6/1970 Buckley ..... 439/321
4,726,782 A * 2/1988 Hager et al. ..... 439/321
5,046,964 A * 9/1991 Welsh et al. ..... 439/271
5,082,454 A * 1/1992 Tonkiss et al. ..... 439/320
5,496,189 A * 3/1996 Over et al. ..... 439/321
5,653,605 A * 8/1997 Woehl et al. ..... 439/321
5,702,263 A * 12/1997 Baumann et al. ..... 439/321

* cited by examiner

*Primary Examiner*—P. Austin Bradley
*Assistant Examiner*—Ross Gushi
(74) *Attorney, Agent, or Firm*—Sidley Austin Brown & wood, LLP

(57) ABSTRACT

An electrical plug connector half connectable with another matching electrical plug connector half and including a housing having a cable entrance, at least one contact carrier located in the housing, a cap secured to the housing at its cable entrance end, a union overlapping the housing and an end of the contact carrier projecting beyond the respective end of the housing and supported on axially spaced, radially projecting annular webs of the housing forming slide bearing regions, and a safety arrangement for preventing an inadvertent rotation of the union in a direction corresponding to release of threaded connection of the plug connector halves, with the safety arrangement being located in an annular space between the axially spaced slide bearing regions and including a circular saw toothing provided on the union or the housing and at least one spring-biased pawl cooperating with the saw toothing and provided an another of the union and the housing.

3 Claims, 5 Drawing Sheets

ELECTRICAL PLUG CONNECTOR HALF

BACKGROUND OF THE INVENTION

1. Field of the Invention

The present invention relates to an electrical plug connector half in particular, to a plug connector half connectable with another matching electrical plug connector half and including a housing having a cable entrance, a traction force compensator for a cable and located in the housing in a vicinity of the cable entrance, at least one contact carrier located in the housing, a cap secured to the housing at its end in which the cable entrance is provided, a union overlapping the housing and an end of the contact carrier projecting beyond an end of the housing opposite the housing end in which the cable entrance is formed, the housing having axially spaced, radially projecting annular webs forming slide bearing regions for supporting the union for rotation about its longitudinal axis, and the union having an inner thread for connecting the plug connector half with the matching plug connector half, means for preventing an axial displacement of the union relative to the housing, and safety means for preventing an inadvertent rotation of the union in a direction corresponding to release of threaded connection of the plug connector halves.

2. Description of the Prior Act

An electrical plug connector half of a type discussed above is described in German Patent No. 4,301,504. In the known plug connector half, the union is rotatably supported on the connector half housing and is associated with locking means that prevents an inadvertent rotation of the union. The locking means consists of a locking crown and matching locking means engaging in the indentation of the crown. The locking crown is formed on an inner circumference of a plastic ring mounted in an annular groove formed at an end of the union adjacent to the cable entrance. The plastic ring is held in the groove by snap-action means. The matching locking means is formed by radially projecting noses provided on the outer circumference of the housing and constantly engaging in the indentation of the crown provided on the union. Because in this embodiment, the plastic ring and the housing are both formed of plastic materials, the holding force of the safety means can only be overcome by an increased force sufficient for compressing the engaging into each other locking elements. Such safety means, as discussed above, requires that the housing also be formed of a compressible plastic material which can be compressed with an acceptable force and have, in view of the fact that the crown is provided at the rear end of the union, a sufficient length.

According to German Patent No. 3,730,033, the housing is formed of two parts connectable by bolts and is provided with a circumferential toothing formed as saw toothing and provided on two spaced from each other longitudinal section. The first toothing is designed to prevent an inadvertent loosening of the threaded connection of the two housing parts, and the second toothing is designed to prevent an inadvertent loosening of the threaded connection of the housing with a cap provided at the cable entrance end of the housing. The inadvertent rotation is prevented as a result of the cap being pressed with its inner circumference in the circumferential toothing provided on the housing. However, such means makes damage-free removal of the cap away from the housing extremely difficult. Moreover, such safety means is unsuitable for preventing an inadvertent rotation of union rotatably supported on the housing.

Each of the two, above-described safety means for components of electrical plug connectors or their halves is based on the use of the deformation resistance of the plastic material and requires application of uniform forces for insertion of the safety means and for overcoming its holding force. This is very inconvenient for the operational personnel.

Accordingly, an object of the present invention is to provide safety means that can be simply and economically produced and can be inserted with a relatively small expenditure of force.

Another object of the present invention is to provide safety means which would provide a number of locking position of the union on the housing.

A further object of the present invention is to provide safety means that would not require increase of the dimensions of the plug connector or its halves.

SUMMARY OF THE INVENTION

These and other objects of the present invention, which will become apparent hereinafter, are achieved by arranging the safety means in an annular space between the axially spaced slide bearing regions of the housing, with the safety means including a circular saw toothing provided on one of the union and the housing and spring-biased pawls means cooperating with the saw toothing provided on another of the union and the housing.

The safety means according to the present invention is designed for use in plug connectors which are subjected during operation to constant shocks and, in particular to high vibrations. More specifically, the inventive safety means is designed for use in plug connectors halves which are to be connected with other halves mounted on apparatuses which generate shocks and vibrations, and where a spontaneous loosening of the union, which connects the two halves, as a result of shocks and vibrations, needs to be prevented.

In order to facilitate establishing of a plug connection by screwing the union on the threaded portion of the another matching plug connector half, the safety means needs to be so design that the screwing is effected with a relatively small force expenditure.

The use, in connection with safety means formed of saw toothing and pawls cooperating with the saw toothing, spring means for biasing the pawls in the engagement direction, permitted to reduce the force expenditure, necessary for the mounting of the safety means, to a very small value, much smaller than was necessary when the safety means, which was based on the compressibility of the safety means components, was used. A particularly small expenditure of force necessary for mounting of the safety means is achieved when the spring-biasing force is at least limited essentially to a force necessary to insure engagement of the pawls with the saw toothing, and the holding effect is primarily obtained by forming cooperating flanks of the saw toothing and the pawl so that they extend steeply in a direction of rotation of the union which results in loosening or release of the threaded connection.

Low insertion and high holding forces are obtained particularly easily when the pawl-biasing spring is formed as a leaf spring and, in particular, as a spring arm or a spring band. Arranging, according to the present invention, the safety means in the already available hollow space in the plug connector half insures that no increase of the dimensions of the connector half is necessary for accommodating the safety means.

According to an advantageous embodiment of the present invention, the saw toothing is provided on an inner circumference of the union, and the pawls are supported on the housing by resiliently deformable support arms.

In order to reliably prevent an inadvertent rotation of the union in the loosening direction even when the pawls are biased into engagement with the saw toothing with a light spring force, according to a further advantageous embodiment of the present invention, there are provided four pawls which are supported pairwise by respective spring bridges on the housing.

According to the present invention, each bridge is formed as an arcuate member having in its middle region a thickness approximately corresponding to a width of the annular space between the union and the housing, with the thickness gradually decreasing to the pawl-carrying bridge regions, so that resiliently deflectable bridge sections are formed. Though, the pawls can be mounted on several bridges, for economical production, the pawls are mounted pairwise on two semi-circular spring bridges.

For purposes of facilitating the assembly of the safety means, the spring bridges are supported on a sleeve and against a sleeve band provided on the sleeve. The sleeve, together with the spring bridges, forms a sub-assembly that can easily be inserted into the plug connector half. The inner diameter of the sleeve corresponds to the outer diameter of the housing in the region between the spaced annular webs. The spring bridges are mounted on a reduced diameter portion of the sleeve.

According to a particularly advantageous embodiment of the present invention, each spring bridge has a middle region and opposite end regions spaced from the middle region. The middle and end regions have a thickness corresponding to a width of a space between the sleeve and an addendum circle of the saw toothing, which is provided on the inner wall of the union, and the pawls of the respective pawl pair are arranged on respective bulging regions of the spring bridge extending between the middle region and the respective opposite end regions, with the bulging regions forming resiliently deformable arms.

The sleeve has approximately diametrically opposite stubs, and each spring bridge has, in the middle region, an opening in which a respective stub engages.

The foregoing structure provides for a particular reliable support of the pawls with respect to the housing or on the sleeve even when the bulging regions are made rather then in order to insure that only a light force acts on the pawls. This insures that upon tightening of the union, the rotation of the union in the loosening direction is prevented by a very small expenditure of force.

Generally, a high resistance of the safety means, which prevents the rotation of the union in the loosening direction is achieved by providing a saw toothing and pawls the respective flanks of which gradually ascend in the rotational direction of the union corresponding to establishing of a connection between the two plug connector halves, with the respective other flanks of the saw toothing and the pawls ascending steeply. The steep ascention of the other flanks results in a resistance to displacement of the pawls relative to the saw toothing substantially increasing upon rotation of the union in a direction corresponding to release of the connection between the plug connector halves.

The foregoing formation of teeth of the saw toothing and pawls results in a small expenditure of force necessary for securing the union on the second connector half, on one hand, and in an increased resistance to rotation of the union in the loosening direction on the other hand.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS:

The drawings show:

FIG. 4 a perspective view of a teeth engagement of the union rotation preventing means at an increased scale; and.

DETAILED DESCRIPTION OF THE PREFERRED EMBODIMENT

Figure 1:
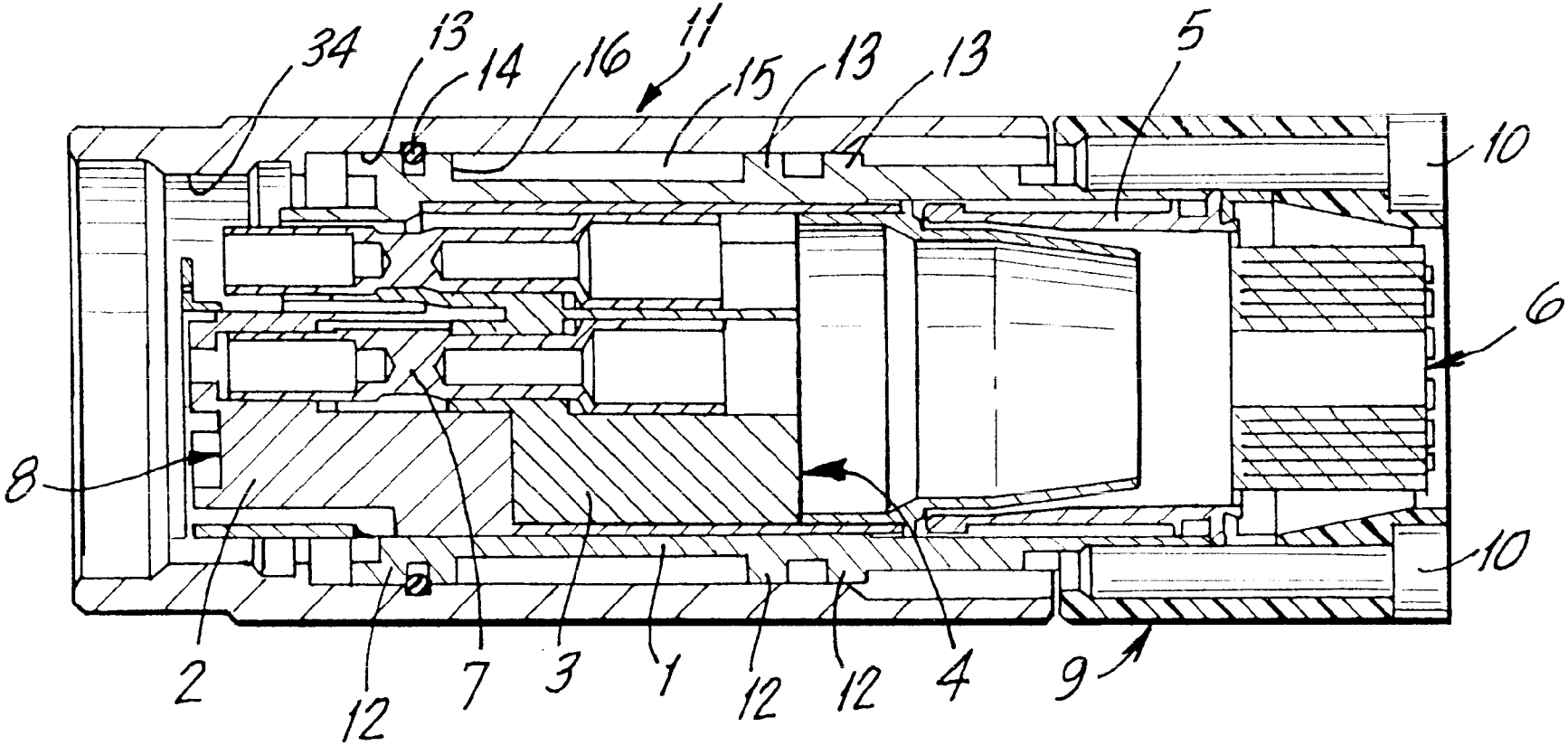
FIG. 1 a longitudinal cross-sectional view of a half of a plug connector according to the present invention with a union.
Figure 2:
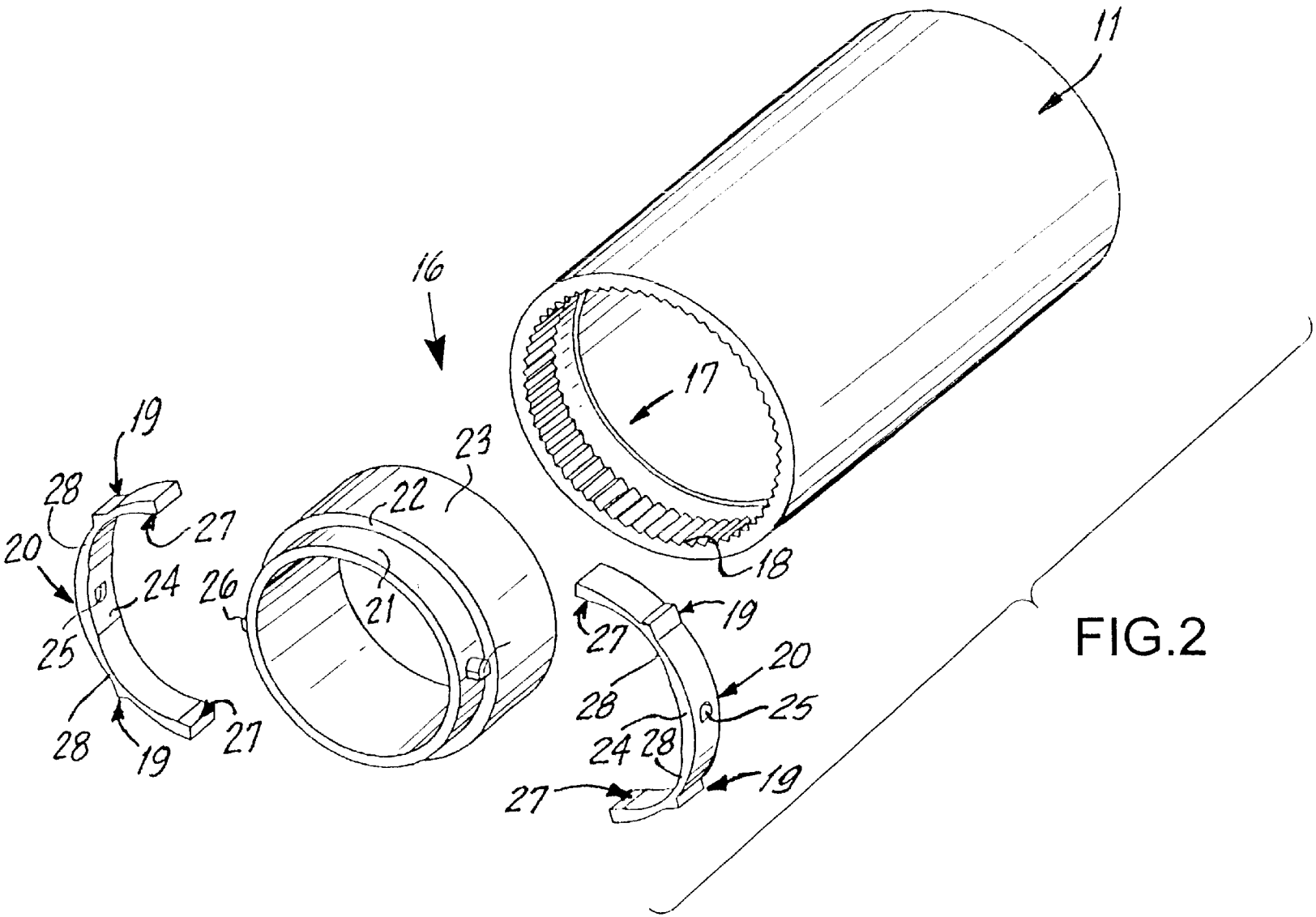
FIG. 2 an exploded view of means for preventing rotation of the union.
Figure 3:
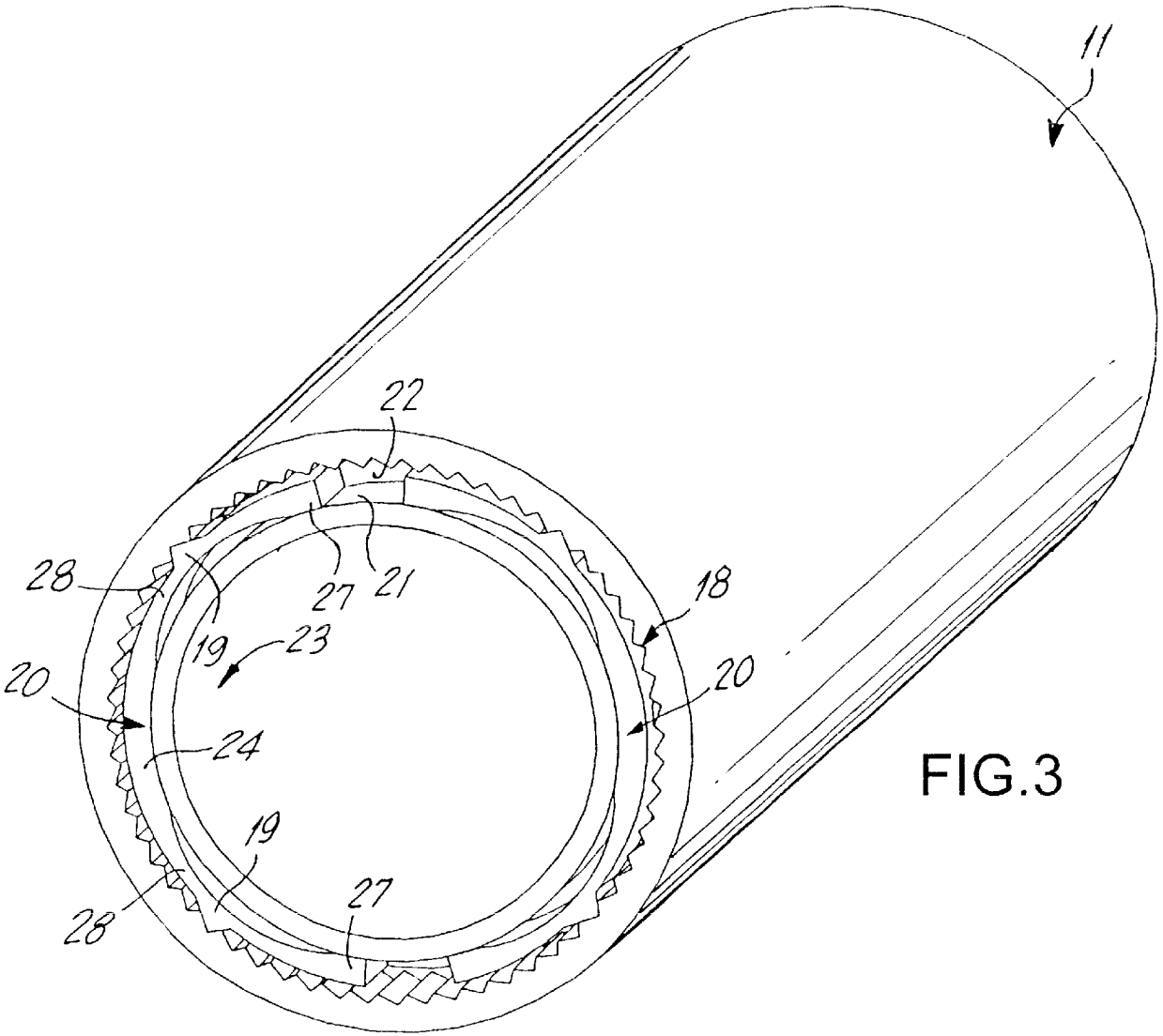
FIG. 3 a perspective view of the union rotation preventing means in its assembled condition.

A plug connector half, which is shown in FIG. 1, has a metal housing 1 in which there are arranged a contact carrier 4, which is formed of two parts 2 and 3, a spacer 5, end of traction force compensator 6 for a cable not shown in the drawings). A plurality of separate contacts 7 are arranged in the contact carrier 4. A free end 8 of the contact carrier 4 projects beyond the end of the housing 1 adjacent to the second plug connector half.

The end of the housing 1, adjacent to the cable entrance, is covered with an end cap 9. The end cap 9 is secured to the housing 1 with bolts 10, forming with the housing 1 a unitary rigid assembly. A union 11, which is formed in its region surrounding the housing, as a cylindrical sleeve, overlaps the housing 1 along its longitudinal extent. The union 11 is rotatably supported for rotation about its longitudinal axis on slide bearing region 13 provided on projecting annular webs 12 adjoining the housing 1. The union 11 is provided with an inner thread 34 in its section extending beyond the housing 1 for connection with the second plug connector half (not shown in the drawings). In the embodiment shown in the drawings, the housing has two, axially spaced from each other, slide bearing regions 13. A safety member 14, which prevents axial displacement of the union 11 relative to the housing 1 is arranged in the slide bearing region 13 adjacent to the free end of the first plug connector half.

A safety element 16, which prevents an inadvertent rotation of the union 11 into its release position and which can be inserted with small expenditure of force but which requires an increased force for overcoming its holding force, is arranged in an annular space 15 which is formed between axially spaced from each other, slide bearing regions 13 and between the inner circumference of the sleeve-shaped union 11 and a longitudinal section of the outer circumference of the housing 1 which is surrounded by the union 11. In the embodiment shown in the drawings, the safety element 16 includes a saw toothing 18, which is provided on the inner circumference 17 of the sleeve-shaped union 11, and pawls 19 cooperating with the saw toothing.

The pawls 19 are provided each on a semi-circular, arch-shaped, spring bridge 20. The spring bridges 20 are supported on a reduced diameter region 21 of a sleeve 23 and which is obtained by upsetting the sleeve 23 by an amount corresponding to a width of the annular shoulder 22. The spring bridges 20 have, in their middle section 24, a material thickening corresponding to the width of the annular space between the addendum circle of the saw toothing 18 and the reduced diameter region 21 of the sleeve 23. The material thickenings in the middle sections 24 of respective spring bridges 20 provides for their planar engagement with the reduced diameter region 21. For securing of the spring bridges 20 on the reduced diameter region 21, the reduced diameter region 21 is provided with substantially diametrically opposite stubs 26 which engage in openings 25 provided in the middle sections 24 of the bridges 20. The spring bridges 20 have each at its both ends, a short section 27 the thickness of which corresponds to the width of the annular space formed between the addendum of the saw toothing and the reduced diameter region 21. The short sections 27 additionally support the spring bridges 20 on the reduced diameter region 21. The pawl 19 is provided on a thin and bulging cross-section 28 which is located between the region 21 abutting sections 24 and 27 of the spring bridge 20. The biasing force applied by the pawl 19 is determined by a degree of thinness of the bulging cross-section 28.

Figure 4:
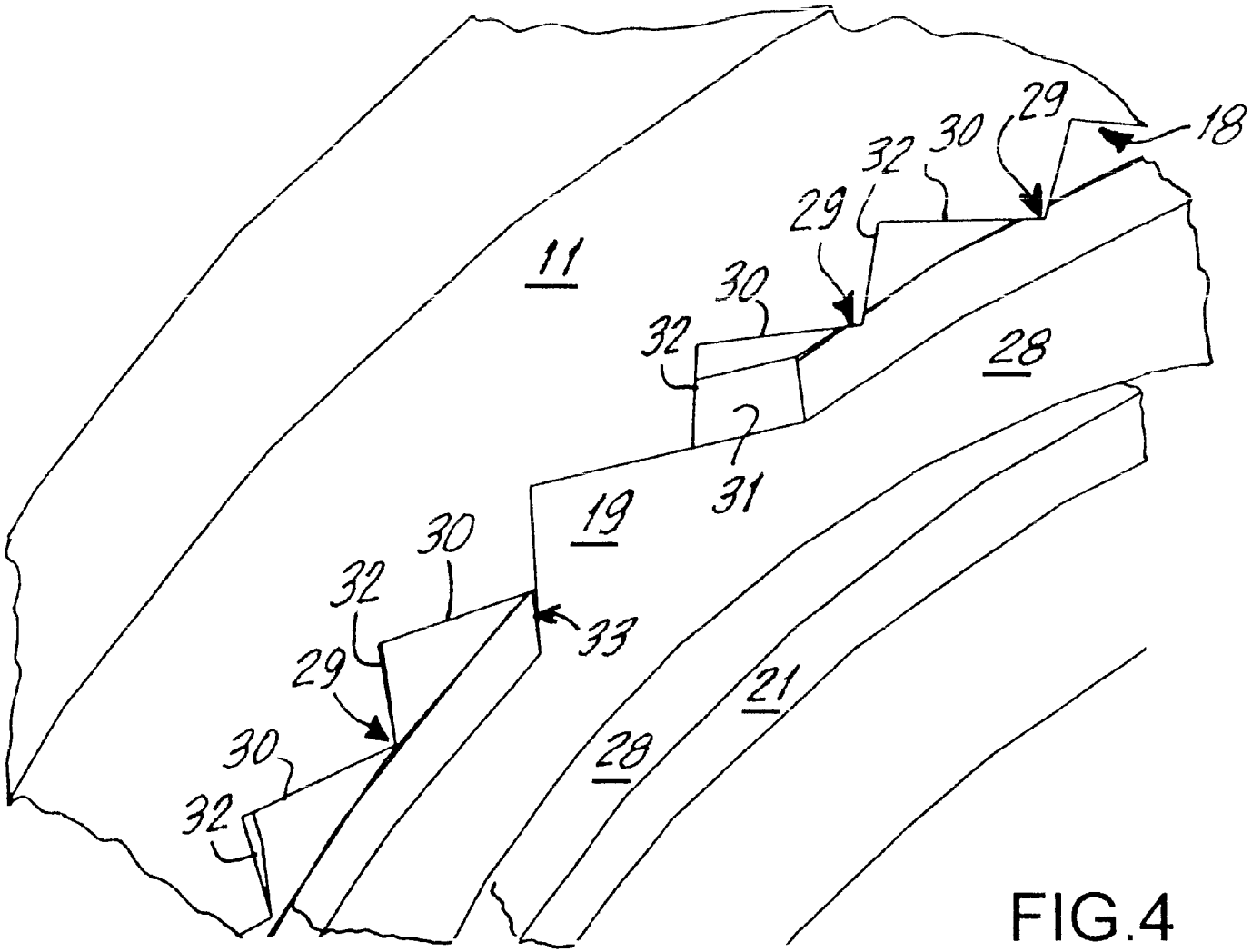
Figure 5:
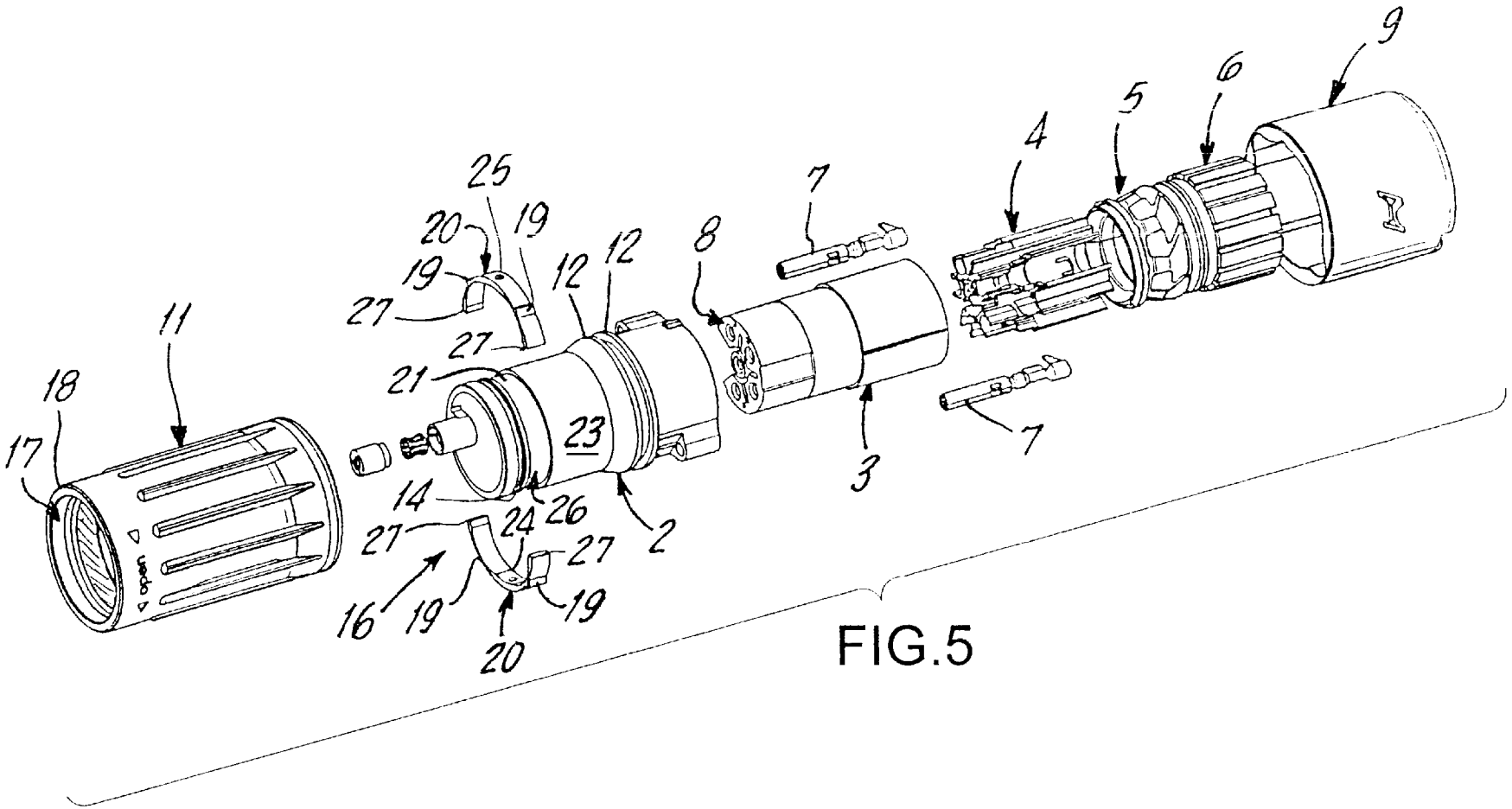
FIG. 5 an exploded view of a half of a plug connector according to the present invention with a union.

As shown in FIG. 4, the teeth 29 of the saw toothing 18 and the pawls 19 do not have symmetrical cross-sections. Further, the flanks 30 of the saw teeth 29 and flanks 30 of the pawl 19 are formed flat and both ascend in a direction of rotation of the union 11 into its closing or connection position. Thus, upon tightening of the threaded connection between two connectable plug connector halves, the pawls 19 would slide over the teeth 19 with minimum resistance.

However, upon rotation of the union in the opposite direction corresponding to the release of the threaded connection between the two plug connector halves, the steeply ascending flanks 33 of the pawls 33 would displace along likewise steeply ascending flanks 32 of the teeth 29 of the saw toothing 18, which would result in a significant resistance hindering the release of the threaded connection between the two plug connector halves.

Though the present invention was shown and described with references to the preferred embodiments such is merely illustrative of the present invention and are not to be construed as a limitation thereof, and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. An electrical plug connector half connectable with another matching electrical plug connector half and comprising a housing having a cable entrance; a traction force compensator for a cable and located in the housing in a vicinity of the cable entrance; at least one contact carrier located in the housing; a cap secured to the housing at an end thereof in which the cable entrance is provided; a union overlapping the housing and an end of the contact carrier projecting beyond an end of the housing opposite the housing end in which the cable entrance is formed, the housing having axially spaced, radially projecting annular webs forming slide bearing regions for supporting the union for rotation about a longitudinal axis thereof, and the union having an inner thread for connecting the plug connector half with the matching another plug connector half; means for preventing an axial displacement of the union relative to the housing; and safety means for preventing an inadvertent rotation of the union in a direction corresponding to release of threaded connection of the plug connector halves, wherein the safety means is arranged in an annular space between the axially spaced slide bearing regions of the housing and includes a circular saw toothing provided on an inner circumference of the union and two spring bridges which are arranged opposite each other and support each two pawls cooperating with the saw toothing, wherein the plug connector further comprises a sleeve with a support band for supporting the two spring bridges, the sleeve with the spring bridges mounted thereon forming a sub-unit mountable in the housing, and wherein each spring bridge has a middle region and opposite end regions spaced form the middle region, the middle and end regions having a thickness corresponding to a width of a space between the sleeve and an addendum circle of the saw toothing, and wherein the pawls of a respective spring bridge are arranged on respective bulging regions of the spring bridge extending between the middle region and the resection opposite end regions and having a reduced thickness, the bulging regions forming resiliently deformable arms.

2. A plug connector half as set forth in claim 1, wherein the sleeve has approximately diametrically opposite stubs, and each spring bridge has, in the middle region thereof, an opening in which a respective stub engages.

3. A plug connector half as set forth in claim 1, wherein the saw toothing and the pawls have asymmetrical teeth with respective flanks of the saw toothing and pawls gradually ascending in rotational direction of the union corresponding to establishing of a connection of the two plug connector halves, and with respective other flanks of the saw toothing and the pawl means steeply ascending, whereby a resistance to displacement of the pawls relative to the saw toothing substantially increase upon rotation of the union is a direction corresponding to release of the connection between the plug connector halves.

* * * * *